United States Patent [19]

Paurat et al.

[11] 4,278,293

[45] Jul. 14, 1981

[54] APPARATUS FOR ADVANCING A LOW-HEIGHT DRIFT THROUGH A SUBTERRANEAN STRUCTURE

[76] Inventors: Friedrich-Wilhelm Paurat, Kasselweg 29, 4230 Wesel; Roland Paurat, Lippestr. 32, 4223 Voerde 2, both of Fed. Rep. of Germany

[21] Appl. No.: 90,621

[22] Filed: Nov. 2, 1979

[30] Foreign Application Priority Data

Nov. 4, 1978 [DE] Fed. Rep. of Germany ..... 2847909

[51] Int. Cl.[3] ..... E21C 27/24; E21C 29/02

[52] U.S. Cl. ..... 299/31; 299/64; 299/87

[58] Field of Search ..... 299/31, 87, 33, 64; 175/91

[56] References Cited

U.S. PATENT DOCUMENTS

| | | | |
|---|---|---|---|
| 3,128,998 | 4/1964 | Sibley | 299/87 X |
| 3,524,680 | 8/1970 | White | 299/31 |
| 3,640,580 | 2/1972 | White | 299/31 |
| 3,874,735 | 4/1975 | Delli-Gatti | 299/87 X |
| 4,095,845 | 6/1978 | Paurat | 299/31 X |
| 4,118,072 | 10/1978 | Kelley et al. | 299/31 X |

FOREIGN PATENT DOCUMENTS 1191775 4/1965 Fed. Rep. of Germany .

OTHER PUBLICATIONS

Glückauf, Dec. 6, 1961, p. 1521.

*Primary Examiner*—Ernest R. Purser
*Attorney, Agent, or Firm*—Karl F. Ross

[57] ABSTRACT

An apparatus for cutting a flat elongated channel, chamber or passage in subterranean strata, e.g. a cross-cut between two mine galleries or shafts, which comprises upper and lower shoes or shields which can be spread apart by a fluid-cylinder system and to which a frame is connected by further fluid cylinders, this frame carrying an excavating worm whose flights are formed with picks for removing the face of the channel to be advanced. A conveyor extends past the frame or through the latter to carry rearwardly the detritus excavated by the worm.

7 Claims, 6 Drawing Figures

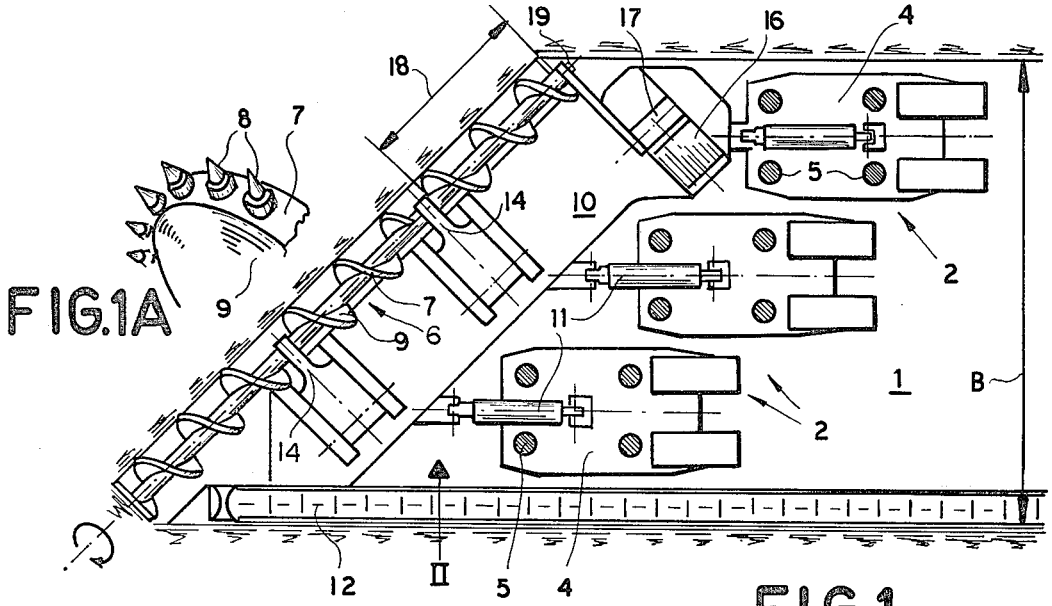
FIG.1A
FIG.1
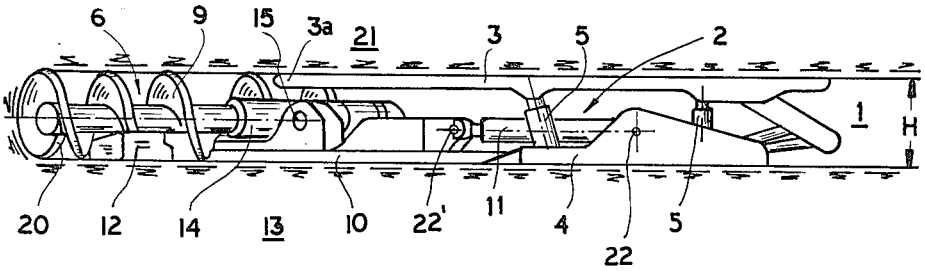
FIG.2
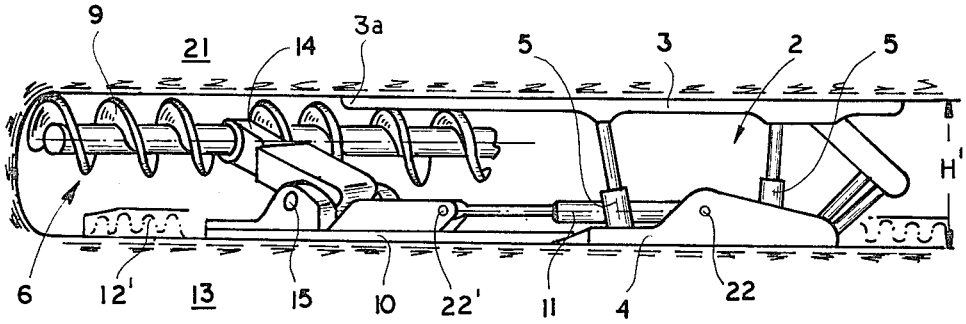
FIG.3

APPARATUS FOR ADVANCING A LOW-HEIGHT DRIFT THROUGH A SUBTERRANEAN STRUCTURE

CROSS REFERENCE TO RELATED APPLICATIONS

This application relates to our copending application Ser. No. 019,095 filed Mar. 9, 1979, to copending application Ser. No. 857,191 filed Dec. 2, 1977 by Friedrich Wilhelm Paurat, to Ser. No. 708,081 filed July 23, 1976 (U.S. Pat. No. 4,095,845 of June 20, 1980), originally copending with Ser. No. 857,191, also by Friedrich Wilhelm Paurat, and to Ser. No. 868,733 (U.S. Pat. No. 4,173,836 of May 13, 1979).

FIELD OF THE INVENTION

Our present invention relates to an apparatus for opening a relatively wide but low-height channel or passage, hereinafter referred to as a drift or cut, in subterranean structures for mining operations, especially between two mine galleries or shafts. More particularly, the invention relates to a machine for the purposes described which comprises a shuttering or timbering means engageable with the floor and roof of the passage, cutting means which is advanced to cut away the face of the passage, and hydraulic or other fluid-operated means associated with this structure.

BACKGROUND OF THE INVENTION

The aforementioned copending applications and issued patent, and the art cited in the files thereof or made of record directly in the application texts, including, for example, U.S. Pat. No. 3,847,438, disclose a variety of mechanical structures for forming trenches, mine galleries and like excavations in subterranean structures, primarily for the recovery of valuable minerals such as coal.

In general, these systems involve the application of a cutting structure to the full height of a gallery to be cut through the subterranean strata and which may be associated with timbering or support equipment which may be separate from or associated with the cutting tools. In some of the modern automatic or semiautomatic gallery cutting machines, roof timbering is braced against the roof of a previously cut portion of the gallery against a shoe or plate lying on the floor thereof and is braced by fluid-operated cylinders. A pivot arrangement mounts a rotary pick structure and can press this structure against the face of the gallery to be cut away while a conveyor removes the detritus.

While such systems have proved to be advantageous for many gallery-forming mineral-mining purposes, problems have been encountered in the formation of relatively flat, i.e. small-height channels or passages in the structure, i.e. in the opening of a crosscut between two shafts.

The term "passage" as used herein is intended to refer to the generally low-height chamber which must be opened before the major gallery-forming and mineral-recovery equipment, with its excavating machine and conveyor can be introduced or to remove coal where such machinery cannot be employed. It can also refer to ventilation passages and passages which can be used to carry away detritus or the recovered mineral matter and will usually be a passage connecting two galleries, a shaft and a gallery or two shafts. The passage is, therefore, referred to hereinafter as a crossdrift or crosscut and these terms will be understood to represent the passage as identified above and which will have relatively small height and relatively large width, i.e. width which can be many times the height. For example, the width can be several meters while the height is usually less than a meter. Thus a crossdrift or crosscut whose formation is the paramount purpose of the present invention is relatively flat, wide and long.

In the opening of a crossdrift in a subterranean structure it is desirable to use mechanized techniques to accelerate the process. However, for thin seams and the advance of the drift along the relatively narrow strata, there are no machines which have proved to be fully suitable to the present time. In general, the opening of the drift is effected by blasting techniques so that personnel must creep with increasing depth into the passage formed in the direction of advance of the drift, drill the desired explosive bores, pack the explosive in, creep back in the opposite direction, and detonate the charges. The coal or drift detritus dislodged from the advancing face of the drift must then be removed by hand with shovels. This is the procedure for advancing drifts of a height of 50 to 70 cm through correspondingly thin seams in coal mines.

Because of the need for direct access of the personnel to the advancing face of the drift, ventilating systems must be carried along together with conveyors and the like.

The advance of the drift is slow because of the need to support the drift with timbering, shuttering and the like. While many attempts have been made to mechanize this process, none of them have been fully successful.

In German patent document DE-OS No. 25 33 518, corresponding substantially to U.S. Pat. No. 4,095,845, there is described an apparatus which makes use of a new type of cutter which is gaining increasing interest in the mechanized advance of excavation in a subterranean setting.

This patent describes inter alia a tool having a helical flight and rotatable about the axis of the helix, the flight being formed with excavating picks which cuts away the coal face as the machine advances this cutter against the face. The excavating drum can be one of a plurality of such drums articulated together end to end and capable of being advanced individually or in groups to chisel away the face.

Each of the excavating drums or drum sections comprises a worm conveyor displacing the detritus axially in the direction of a conveyor which may be a bucket, trough, belt or flight conveyor advancing with the machine as the latter cuts away the face of the gallery wall.

The articulated excavating drums, with their helical conveyor ribs and chisels or picks at the periphery thereof are thus combined with a rearwardly extending conveyor to form a continuously advancing excavating machine whose cutting tools can be advanced against the strata to be cut away and recovered and which can be raised and lowered to excavate thick seams or veins.

While all of these mechanical systems have resulted in major advances in mining, especially coal mining, and rapid formation of galleries with recovery of the desired mineral matter they have not solved the problem of opening low-height cuts or passages as heretofore described as crossdrifts and crosscuts.

OBJECTS OF THE INVENTION

It is the principal object of the present invention to provide an excavating machine for the subterranean propagation or opening of a low-height cut or passage, such as a crossdrift between galleries, which is particularly suited for the recovery of coal or other mineral matter from relatively thin veins and which can be used with particular effectiveness in the formation of low-height wide drifts without the manual effort heretofore required.

It is another object to provide an apparatus for the fully automatic opening of a crossdrift in a subterranean structure, e.g. through the excavation of thin veins extending from existing galleries or shafts.

SUMMARY OF THE INVENTION

These objects and others which will become apparent hereinafter are attained, in accordance with the present invention, in an apparatus which comprises a cutter means extending the full width of the drift to be excavated and formed from at least one excavating worm with at least one generally helical flight formed with picks or chisels adapted to cut away the front of the drift upon rotations of this cutter and advance the cutter against the drift in a direction generally transverse to the axis.

According to an essential feature of the invention, the cutter means as thus defined is journaled for rotation in a manipulating frame which is connected by suitably hydraulic (fluid-responsive) devices to respective support or timbering units of which at least two are provided in mutually spaced apart relationship across the width of the drift and which form a machine support extending substantially the full width of the drift.

In addition, according to the invention, a conveyor is provided which extends past the aforementioned support to a forward portion of the machine at which it collects the excavated product laterally displaced by the cutter to carry this product rearwardly past the support and either through or along the support, to a location remote from the excavation zone. This conveyor, which can be a trough and/or flight conveyor, can carry the detritus along the floor to the next gallery or shaft.

According to the invention, the drive of the cutter drum or drums, the journals thereof on the frame and the fluid-responsive devices for advancing the cutter are located directly behind the cutter so as to be shielded thereby or in the shadow thereof with respect to the advance of the cutting tool.

According to the invention the worm conveyor is supported upon a platform which is shiftable along and rests upon the floor of the cut and can be driven forwardly by selective operation of the hydraulic devices which are connected to the bracing elements spaced apart across the full width of the cut and including roof and floor braces spread apart by respective cylinder arrangements. The aforementioned platform can also be connected to the leading end of the strut or flight conveyor.

Once the cutter worm has advanced into the face of the subterranean stratum which is to be removed to form the cut, the individual bracing units can be relieved and the advancing cylinder arrangement used to draw the respective unit forwardly whereupon the bracing units are again spread against the floor and roof of the cut to permit further advance of the cutting worm and, naturally, entrainment of the flight or strut conveyor therewith.

According to a feature of the invention, the worm cutter is journaled on arms on the respective frame or platform and these arms can be swingable about horizontal axes in, for example, planar sense, thereby increasing the height of the cut beyond the effective diameter of the cutting worm.

In another feature of the invention the cutter worm can be composed of a plurality of sections which can be rigidly connected to one another and can be provided with a common drive.

While the drive for the worm can be an external-rotor motor provided within the cutter drum, the motor and any transmission necessary therefor can be provided upon the frame or platform. It can also be provided on a journal system which can be raised and lowered with the worms as desired.

While we prefer to use as the rearwardly extending conveyor a chain-type flight conveyor, it should be noted that other conveyor systems may be employed as well, e.g. a worm-type conveyor. For example, this rearwardly extending conveyor may be a multiple-worm conveyor having two or more parallel worms which enables large pieces to ride rearwardly on the worm conveyor without difficulties.

Of course, the cutter worm should be driven in a sense of rotation ensuring that the coal excavated by this worm will travel transversely to the direction of advance of the cut into the trough of the flight conveyor. Naturally, the groove formed in the coal by the cutter defines a channel which cooperates with the flights of the worm in conveying the removed material out of the path of the machine. Of course, the cutter worm can also be provided with channel-forming members to facilitate this movement of the material, these channel forming members being disposed between the worm and the bracing system.

BRIEF DESCRIPTION OF THE DRAWING

The above and other objects, features and advantages of the present invention will become more readily apparent from the following description, reference being made to the accompanying drawing, in which:

FIG. 1 is a plan view, partially broken away, of the excavating machine of the present invention, the roof of the cut having been removed;

FIG. 1A is a detail view of one of the flights of the worm cutter of FIG. 1;

FIG. 2 is a view taken in the direction of the arrow II of FIG. 1 with the flight conveyor broken away or removed;

FIG. 3 is a view similar to FIG. 2 showing the apparatus in another function mode;

SPECIFIC DESCRIPTION

Figure 4:
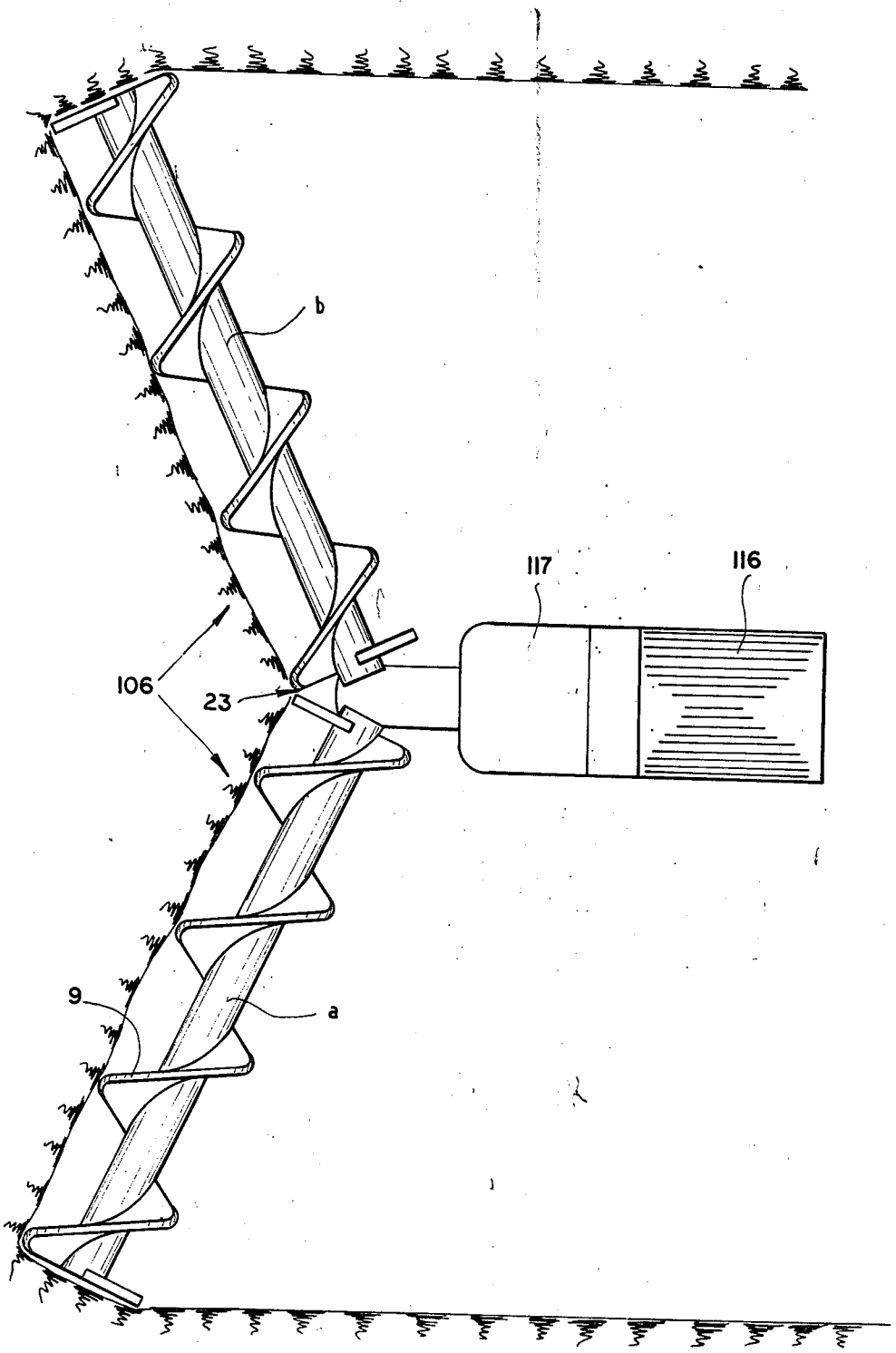
FIG. 4 is a plan view drawn to a larger scale but illustrating a modification thereof with a different cutter.

The machine illustrated in the drawing is intended to recover coal from so-called cross drifts which may bridge mine shafts or galleries and generally are of comparatively low height and large width. In the case of the present invention, the width is represented at B. To recover the coal in such crossdrifts, a cut, namely a crosscut, is opened in the subterranean structure as is represented at 1 and in the embodiment illustrated the crosscut 1 extends between two shafts which have not been illustrated once the cut is completed. The width B is usually about 5 to 6 meters while the height H or H' (FIGS. 2 and 3) can be some 60 to 70 cm.

The apparatus comprises a bracing means represented generally at 2, a cutter means represented generally at 6 and a conveyor 12 which carries the excavated coal away. According to the invention, the bracing means 2 is formed with a plurality of bracing units, each of which has an upper shoe, a shield or plate 3, a lower shoe, shield or plate 4 and spreading piston-and-cylinder arrangement represented at 5 which may be articulated to the shoes or shields of the respective bracing units.

The bracing units 3-5 are spaced apart across the width B of the cut and the upper shields 3 can have forwardly extending cantilever portions 3*a*, as shown in FIGS. 2 and 3 substantially to the region of the worm 6.

The cutting unit comprises a worm arrangement 6 which is inclined to the direction of advance but extends the full width B of the cut, being formed with helical worm flights 9 along the rims 7 of which are provided picks 8 as shown in FIG. 1A (see also U.S. Pat. No. 4,095,845).

The platform 10 can be driven forwardly with the aid of a plurality of piston-and-cylinder arrangements 11 articulated at 22 to the respective floor shoes 4 and as shown at 22' to the platform 10.

In the embodiment illustrated, each of the three bracing units has a respective cylinder arrangement 11. The assembly of bracing units forms a support structure which is traversed or flanked by a flight conveyor 12 which is disposed at the discharge end of the worm 6 and is connected to the platform 10 while running rearwardly to the shaft at which the cut originates. In the embodiment shown in FIGS. 1 through 3, this shaft lies to the right of the drawing.

The worm cutter 6 is journaled on arms 14 which, in turn, are pivotal on the platform 10 although they can also be rigid therewith. However, when pivoting is desired, e.g. to increase the height of the cut (compare FIGS. 2 and 3 ), the arms 14 may be swung about horizontal axes 15 by conventional means, e.g. that described in U.S. Pat. No. 4,095,845 which also shows the additional trough-forming members which can cooperate with the worm cutter to assist in carrying the coal to the flight conveyor 12.

FIGS. 2 and 3 show clearly that the platform 10 rides on the floor of the cut and, naturally, this platform can be formed with skids or runners for this purpose.

The cutter 6 can be assembled from a plurality of sections and these sections can be added to if necessary for the desired width of the cut. However, the width of the cut can be changed as well by varying the angle formed between the axis of the worm and the direction of advance.

The worm shown in FIGS. 1 through 3 is driven by a motor 16 and a speed reducing transmission 17 which are mounted on the platform 10, the drive being disposed in the shadow of the worm 6, i.e. directly behind the latter, journal locations 19 being likewise located in the shadow of the cut, i.e. wholly within the path excavated by the inclined cutter drum.

As has been shown only diagrammatically, between the cutter worm 6 and the flight conveyor 12, a transfer device formed, for example by transfer pockets 20 on the worm, can be provided to ensure positive lifting of the excavated material into the flight conveyor 12.

While the conveyor 12 is shown as a chain-type flight conveyor in FIG. 1, the modification in FIG. 3 illustrates diagrammatically at 12' that a worm conveyor can be used as well.

The upward swinging movement of the arms 14 can also be used to raise the cutter worm and clear the roof of the cut. Naturally, some of the coal falling down will not be carried at this point into the conveyor 12 or 12'. Thus the worm cutter 6 is lowered to sweep this coal into the conveyor.

The reaction force during the lifting of the conveyor worm is taken up in part by the weight of the platform 10 and in part by transfer to the bracing units.

The pivots 22 are designed to minimize the transfer vibration and chattering and may have the shock or vibration damping characteristics of the pivots described in the copending applications mentioned above. In any event the platform 11 should have a minimum height so that it is possible for personnel to crawl over it to reach the picks 8 for replacing them as may be required.

Another embodiment of the invention is illustrated in FIG. 4 in which the two worm sections a and b of cutter worm 106 project forwardly in a diverging manner to provide a vertex 23 of the V which is seen in projection on the floor 13 of the cut. The drive 116, 117 for the conveyor worm 106 has been represented as being connected to the sections a and b, the worm otherwise being provided with picks and cooperating with flight conveyors as described in connection with FIG. 1. In this case, however, two flight conveyors may be provided on opposite longitudinal sides of the cut.

Figure 5:
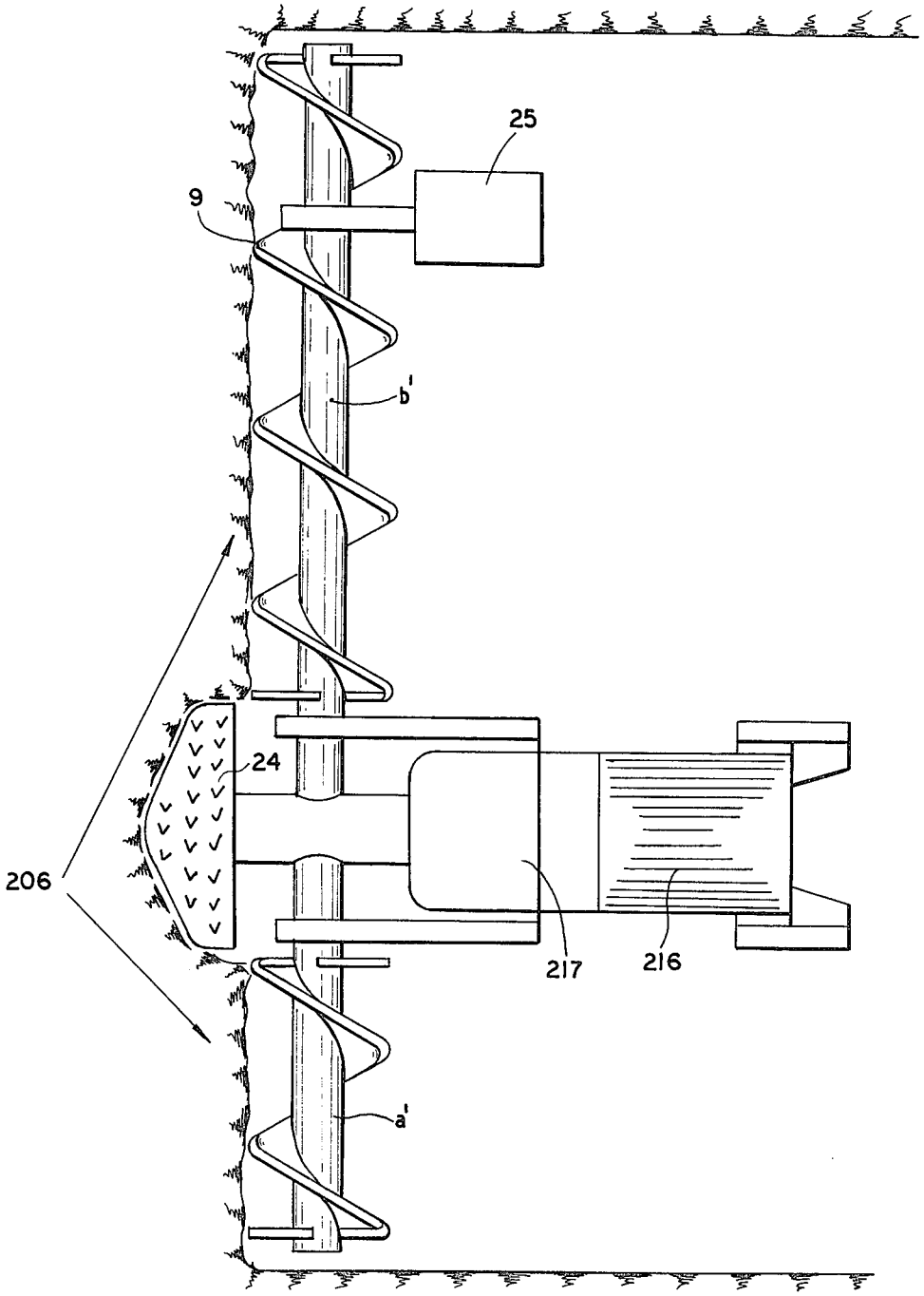
FIG. 5 is a view similar to FIG. 4 of still another embodiment of the invention.

In the region of the vertex 23 an additional cutting tool such as the rotary cutter 24 of FIG. 5 can be provided.

FIG. 5 shows an embodiment in which the drive 216, 217 for the worm 206 is somewhat off-center and the sections a' and b' are disposed in line and transverse to the direction of advance of the cutter head. Naturally, a system can also be used wherein the vertex of the mutually inclined worm points forwardly. Between the worms, the rotary cutter 24 is provided, the cutter 24 being driven by the motor 216 and the transmission 217.

Special bracing units such as have been represented at 25 can be used to journal specific portions of the cutter worms and can be braced against the roof and floor of the cut as described for the units 3,4,5 while being pivoted on the platform or pivotally connected to the worms to allow swinging movement of the worms as represented in FIG. 3 or so as to support the worms against reaction forces.

In operation, the units 3,4,5 disposed as shown in FIG. 1, are braced between the floor and roof of the cut by expansion of the cylinder units 5, whereupon the cylinder units 11 are pressurized to force the platform 10 and the cutter 6 forwardly, thereby drawing the conveyor 12 past the machine support formed by the bracing units. Rotation of the cutter carries the coal into the conveyor 12.

When the cylinders 11 are fully extended, one of the bracing units is relieved by contracting its cylinders 5 and the respective cylinder 11 is oppositely pressurized to draw the shoes or shields of the relieved bracing unit toward the platform 10. The cylinders 5 of this unit are again pressurized and the process is repeated with each of the bracing units, whereupon the apparatus is ready for the next advance of the cutter head.

We claim:

1. An apparatus for advancing a cross-cut having a roof and a floor in a subterranean structure and for excavating material from said structure with the advance of the cross-cut, said apparatus comprising:

bracing means including a plurality of bracing units spaced apart transversely of the direction in which the cross-cut is to be advanced, each of said bracing units comprising a floor-engaging shield, a roof-engaging shield and fluid pressure means for bracing said shields against said floor and said roof, respectively;

cutter means adapted to be shifted in a direction of advance relative to said bracing means and including:

an elongated support frame parallel to said shields and connected to each of said bracing units by a respective fluid-pressure cylinder arrangement, said frame being inclined to said direction of advance, at least one cutter worm journaled on said support frame and inclined to said direction of advance, said cutter worm being formed with a generally helical formation provided with picks engaging said structure for removing said material therefrom, means for rotating said worm about a generally horizontal worm axis and inclined to said direction of advance, and a plurality of arms swingable on said support frame about horizontal axes parallel to said worm axis and rotatably carrying said worm;

and a material-removal conveyor extending into said cut past said bracing means to the region of said cutter conveyor for leading material away from said cutter conveyor, said material-removal conveyor resting upon said floor.

2. The apparatus defined in claim 1 wherein said rotating means includes a motor and a transmission mounted on said support frame and operatively connected to said worm.

3. The apparatus defined in claim 2 wherein said worm is inclined to the direction of advance thereof and said motor and transmission lie in the shadow of advance of the worm.

4. The apparatus defined in claim 1 or claim 4 wherein said support frame is a platform riding on said floor.

5. The apparatus defined in claim 1 wherein said worm comprises a plurality of worm sections inclined to one another and forming a V.

6. The apparatus defined in claim 5 wherein the V opens in the direction of said advance.

7. The apparatus defined in claim 1 wherein said worm is provided with pockets for transferring said material to said material-removal conveyor.

* * * * *